US006027302A

United States Patent [19]

Nilsson

[11] Patent Number: 6,027,302

[45] Date of Patent: Feb. 22, 2000

[54] CLAMP FORCE CONTROL FOR LOAD-HANDLING DEVICE

[75] Inventor: Hans Nilsson, Umeå, Sweden

[73] Assignee: Nymek AB, Skelleftea, Sweden

[21] Appl. No.: 08/837,818

[22] Filed: Apr. 22, 1997

[30] Foreign Application Priority Data

Apr. 26, 1996 [SE] Sweden ..... 9601602

[51] Int. Cl.[7] ..... B66C 1/42; B66F 9/06

[52] U.S. Cl. ..... 414/621; 294/88; 294/907; 414/636; 414/911

[58] Field of Search ..... 414/618, 619, 414/621–623, 631–638, 911; 294/88, 907

[56] References Cited

U.S. PATENT DOCUMENTS

| | | | |
|---|---|---|---|
| 4,161,256 | 7/1979 | Seaberg | 414/621 X |
| 4,215,622 | 8/1980 | Chichester | 414/621 X |
| 4,467,894 | 8/1984 | Sinclair | 414/621 X |
| 4,491,918 | 1/1985 | Yuki et al. | 414/636 X |
| 4,714,399 | 12/1987 | Olson | 414/621 |
| 4,730,862 | 3/1988 | Caen et al. | 294/88 |
| 4,783,106 | 11/1988 | Nutter | 414/621 X |
| 5,292,219 | 3/1994 | Merin et al. | 414/621 |
| 5,370,435 | 12/1994 | Monk et al. | 414/621 X |
| 5,417,464 | 5/1995 | Seaberg et al. | 294/907 X |

FOREIGN PATENT DOCUMENTS

| | | | |
|---|---|---|---|
| 2636473 | 2/1978 | Germany . | |
| 3245715 | 9/1983 | Germany . | |
| 940976 | 11/1963 | United Kingdom | 414/621 |

*Primary Examiner*—David A. Bucci
*Attorney, Agent, or Firm*—Birch, Stewart, Kolasch & Birch, LLP.

[57] ABSTRACT

A control is provided for a load-handling device that includes a hydraulic gripper (14) which is intended to grip objects, such as one or more rolls or bales of paper material or other goods, through the medium of pressure in a clamping pressure line (32) leading to one or more hydraulic cylinders (30) that actuate gripping arms on the gripper (14), and on the other hand to lift the objects by actuation from a lifting device (22, 42). The clamping force is adapted to the lifting force during a clamping and lifting operation, by, among other things, monitoring the lifting force of the lifting device (42) with the aid of sensor member. A pressure reduction valve (36) is provided in the clamping pressure line (32), and a control member (50) is provided for controlling the pressure reduction valve (36) to a pressure in the clamping pressure line (36) that is proportional in the lifting force detected by the sensor member (60).

4 Claims, 2 Drawing Sheets

CLAMP FORCE CONTROL FOR LOAD-HANDLING DEVICE

BACKGROUND OF THE INVENTION

1. Field of the Invention

The present invention relates to a force control for controlling a load-handling device that includes an hydraulic gripper adapted on the one hand to firmly grip objects, such as one or more rolls or bales of paper material or other goods, through the medium of pressure in a clamp pressure line leading to one or more hydraulic cylinders that actuate gripper-mounted gripping arms, and on the other hand to lift said objects by actuation from a lifting device.

2. Description of Background Art

Great demands are placed on paper-rolls, particularly for printing presses, that the rolls will not be squeezed to an oval shape during handling of the rolls from a paper mill to a printing department. For instance, the tolerance placed on a roll 125 cm in diameter may sometimes be as narrow as 2 mm measured on the radius of the roll. Different solutions have been proposed in endeavours to optimally control the clamping force of the gripper against the roll periphery. EP-A-0664272 and FI-B-84715, among others, teach devices for controlling the clamping or gripping forces in response to detected sliding at the gripping surfaces.

SUMMARY AND OBJECTS OF THE INVENTION

One object of the present invention is to provide a control of the kind defined in the introduction that is capable of continuously controlling the clamping force towards an optimal value during a combined clamping and lifting movement sequence.

This object is achieved by a combination of elements wherein a sensor member is provided for detecting the lifting force exerted by a lifting device. A pressure reduction valve is included in a changing pressure line. A control member is provided for controlling the pressure reduction valve to a pressure in the changing pressure line that is proportional to the detected lifting force.

According to one aspect of the invention, there is sensed the gravitational force acting on the lifting device during the combined clamping and lifting operation, wherein a pressure reduction valve in the clamping pressure line controls the pressure in said line proportionally to the sensed lifting force. This ensures that the clamping force will never exceed a predetermined percentage of the weight of the load.

Other features of the invention and advantages afforded thereby will be evident from the claims and from the following description.

BRIEF DESCRIPTION OF THE DRAWINGS

Embodiments of the invention will now be described with reference to the accompanying drawings, in which.

DETAILED DESCRIPTION OF THE PREFERRED EMBODIMENTS

Figure 1:
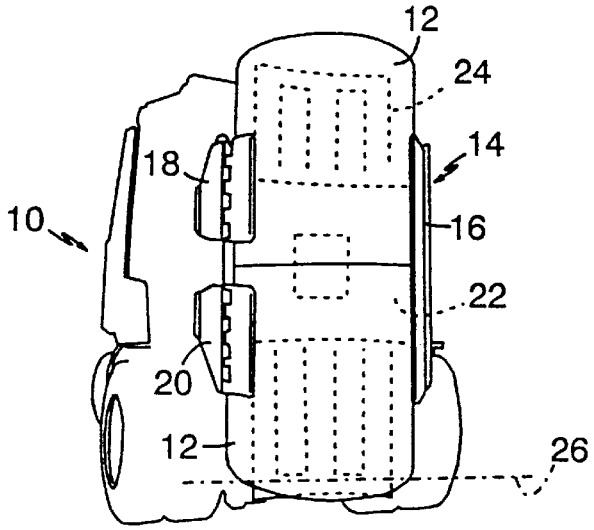
FIG. 1 is a simplified perspective view of a load-handling device with which the invention is intended to be applied.

In FIG. 1, a carrier or a vehicle 10, such as a fork-lift truck, an articulated wheel-mounted loader or like vehicle is illustrated with a known load-handling device in the form of a roll-clamping unit mounted thereon. The roll-clamping unit of the illustrated embodiment is intended to grip and lift two rolls 12 simultaneously and includes a gripper 14 having mutually opposed gripping arms 16 and 18, 20 respectively. The gripping arms are hinged on a frame 22 so as to be raisable and lowerable thereon. The frame 22 is mounted on a generally vertical stand 24 which, in turn, can be swung or tilted relative to the truck 10 about an axis 26. The frame 22 may also be rotatable about a horizontal axis with respect to the stand 24, so as to enable the rolls 12 to be brought to a horizontally lying position (not shown).

The gripper 14 may be one of a number of different variants having different numbers of fixed and movable gripping arms. In the examples illustrated in FIGS. 2 and 3, the movable gripping arms are operated by double-acting hydraulic cylinders 30, wherein the six hydraulic cylinders 30 of the FIG. 3 embodiment are intended for operating the outer gripping arms of a multi-roll unit, for simultaneous gripping of a pair of juxtaposed roll stacks (not shown) towards a centre tongue of the unit.

Each double-acting hydraulic cylinder 30 receives clamping or closing pressure from a hydraulic line (clamping pressure line) 32 and an opening pressure from an hydraulic line 34. The frame 22 is lifted through the medium of one or more hydraulic cylinders 42 (only one is shown) which receive lifting pressure from a hydraulic line 44. The stand 24 is tilted through the medium of double-acting hydraulic cylinders 66 which are driven in opposite directions by pressure arriving from respective hydraulic lines 68 and 70. The pressure in the lines 68, 70 is controlled by an electromagnetically controlled directional valve 72, to which pressure is delivered via an inlet line 74 and an outlet line 76.

The output of an electromagnetically proportion-controlled pressure reduction valve 36 is connected to the line 32 that delivers clamping pressure to the gripper 14, and the input of said valve 36 is connected to a supply line 40. A check valve 38 connected in parallel with the pressure reduction valve 36 ensures that hydraulic fluid in the line 36 can flow back past the pressure reduction valve 36 when opening the gripper 14.

Extending between the supply line 40 and the supply line 44 to the single-acting cylinder 42 of the lifting means 22 is a hydraulic line 46 in which there is connected a sequence valve 48 which is adapted to connect the supply line 40 with the supply line 44 and to drive the lifting means 22 when the pressure in the supply line 40 reaches a pressure level set on the sequence valve 48.

Figure 2:
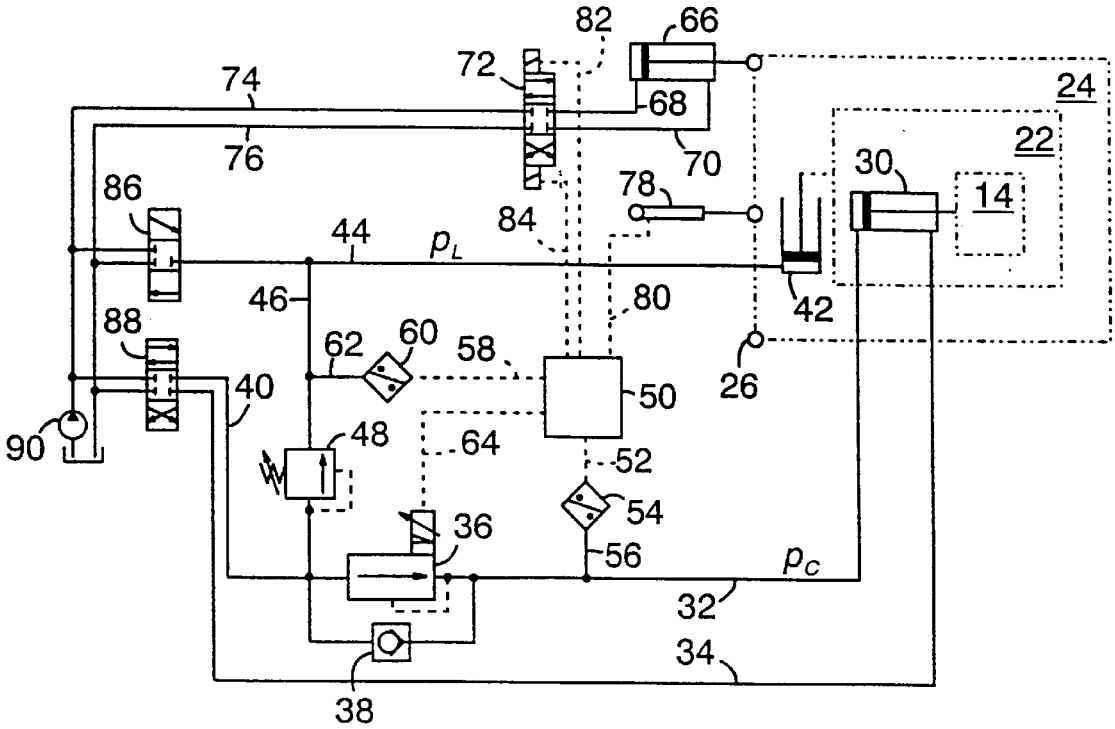
FIG. 2 shows an hydraulic circuit that includes the principles of the invention.
Figure 3:
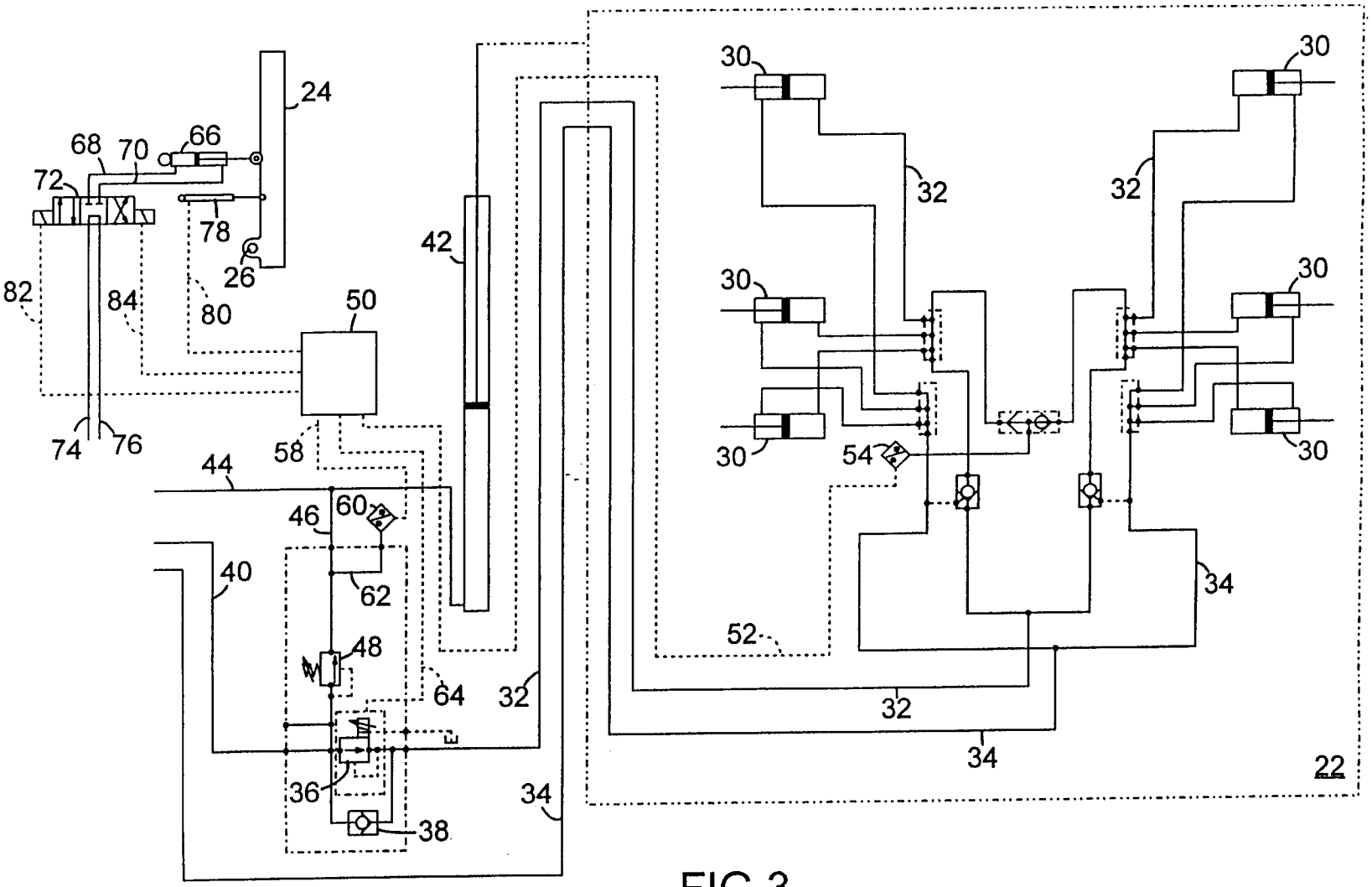
FIG. 3 is a more detailed hydraulic circuit for an inventive load-handling device.

As will be seen from the principle presentation of the circuitry in FIG. 2, there is also included a pair of directional valves 86 and 88 and a drive source that includes a hydraulic pump 90. The directional valve 86 is adapted for operator actuation of the hydraulic cylinder 42. Correspondingly, the directional valve 88 is also adapted for operator-actuation of the gripper 14, i.e. closing and opening of the gripper. The valve 72 may also be operator-actuable for controlling the tilt function independently of the control system described in the following.

The various functions, the clamping force of the gripper 14, the lifting force of the lifting means 22, and the angle to which the tilt means 24 is inclined relative to the vehicle 10, are monitored by respective sensors 54, 60 and 78. More specifically, the sensors 54 and 60 of the illustrated embodiment are pressure sensors which sense the pressure prevailing in respective cylinders 30 and 42 via lines 56 and 62 respectively. Thus, the pressure sensed by the sensor 54 is a measurement of the clamping force exerted by the gripper, and the pressure sensed by the sensor 60 is a measurement of the lifting force exerted by the lifting means 22. The sensor 78 is a position sensor and senses the position of a point on the stand 24 in relation to the truck, wherewith this position can be readily converted to a measurement of the angle to which the stand 24 is tilted about the axis 26 in relation to the truck 10. By way of an alternative, the aforedescribed pressure sensors 54 and 60 may be replaced with force sensors, e.g., in the form of load cells for detecting clamping force and pressure force (not shown).

The outputs of the sensors 54, 60, 70 are connected to a central electronic control unit 50 by means of respective signal conductors 52, 58 and 80. The control unit 50 is connected to the control input of the proportional control reduction valve 36 by means of a signal conductor 64. A pair of further outputs of the control unit 50 are connected to the control inputs of the directional valve 72 by means of a respective signal conductor 82 and 84.

The control unit 50 includes a programmable microcomputer of a known kind capable of registering continuously the incoming sensor signals and continuously varying the outgoing signals in response to changes in the incoming signals with the aid of a computing program.

The inventive control functions in the following manner:

When one or more rolls 12 standing on a support are to be gripped and lifted by the load-handling device, the first line 40 is pressurized, e.g. by setting the directional valve 88 to its lower position in FIG. 2. The directional valves 72 and 86 initially remain in their illustrated closed states. The pressure reduction valve 36 is initially open until there is reached in line 32 a pressure that provides a desired initial roll-clamping force in the cylinder 30. This force is detected by the sensor 54, which then sends to the control unit 50 a signal to the effect that the pressure reduction valve 36 shall be closed.

The pressure in the line 40 connected to the input of the sequence valve 48 then increases, such that when the inlet pressure overcomes the spring force of the sequence valve 48 hydraulic fluid is forced into the lines 46 and 44 and the cylinder 42 then commences to lift the gripper that clamps the rolls.

Installed in the computing program of the control unit 50 is an adjustable, predetermined proportionality constant which gives the optimal quotient Q between the clamping pressure $p_c$ in the line 32 and the lifting pressure $p_L$ in the line 44, so that the clamping force exerted by the gripper during the entire clamping and lifting sequence will have a magnitude such that the gripper 14 will not deform the rolls and such that the rolls are unable to slide down between the gripping arms of said gripper 14.

Accordingly, it is ascertained continuously in the control unit 50 during the entire lifting sequence whether or not the real or prevailing value of $p_c$ signalled by the sensor 54 coincides with the set-point value or control value $Q \times p_L$. If such is not the case, the control unit 50 delivers a signal on the line 64 which adjusts the setting of the pressure reduction valve 36 in a direction towards the set-point value on $p_c$ in the line 32.

During the aforedescribed sequence, the clamping force exerted by the gripper 14 will thus be adapted (increased) continuously in proportion to the increasing lifting force during the moment at which the gripper 14 releases the paper roll or rolls 12 from the support.

During the described sequence in which the paper roll or rolls 12 leave the supportive surface, the truck 10 will also unavoidably "curtsy" as a result of the load. In order to prevent the bottom front edge of the bottom roll 12 from being subjected to excessively large local pressure forces against the supportive surface, such as to deform the roll and render it unusable, the tilt function of the load-handling device is controlled in the following way:

The aforesaid "curtsying" of the truck is generally proportional to the force that acts on the lifting device 22 and the cylinder 42, and therewith generally proportional to the pressure $p_L$ in the line 44. It is therefore necessary for the gripper 14 and the stand 24 to be tilted back about the axis 26 during the gripping and lifting sequence proportionally to the increasing pressure $p_L$, with the aid of the cylinder 66. To this end, the computing program of the control unit 50 includes a function which controls the directional valve 72, via the signal lines 82, 84, to adjust the hydraulic cylinder 66 proportionally to the pressure $p_L$ detected by the sensor 60. The real value of the adjustment or tilt is monitored by the position sensor 78 and is corrected towards the set-point value by signals sent from the control unit 50 to the directional valve 72.

This will thus ensure that the load-handling device, with or without load, will constantly maintain a preset inclination relative to the supportive surface, particularly so that the roll 12 standing on the supportive surface will be lifted essentially parallel from said surface. Control of the tilt function is also reversible, so as to enable a roll to be deposited flatly on the supportive surface without danger of the roll edges being damaged.

I claim:

1. A control for a load-handling device including a hydraulic gripper adapted on the one hand to firmly grip an object by means of pressure in a clamping pressure line leading to one or more hydraulic cylinders that actuate gripping arms on the gripper, and on the other hand to lift said object by actuation from a hydraulic lifting device comprising:

sensor means for detecting the lifting force exerted by the lifting device;

control means for controlling a pressure reduction valve to a pressure in the clamping pressure line during a clamping and lifting sequence such that said object is not deformed;

said sensor means is a pressure sensor sensing the prevailing pressure in the lifting device; and said control means, during said sequence until said object is leaving a supporting surface, being adapted to control the pressure reduction valve to a pressure in the clamping pressure line by an adjustable preset proportion of said detected lifting force, such that the clamping force of the gripper is continuously adapted to the lifting force and that said object is not allowed to slip downwards between the gripping arms.

2. Control according to claim 1, characterized in that the pressure reduction valve is a proportional-controlled pressure reduction valve (36) adapted to control the pressure in the clamping pressure line (34) in predetermined direct proportion to the detected lifting force.

3. Control according claim 1, characterized by sensing means (54) for detecting the clamping force exerted by the gripping means (30).

4. Control according to claim 1, characterized by a tilt means (24, 26, 66) adapted to tilt the load-handling device relative to a load-handling device carrier (10), and tilt sensing means (78), wherein said control means (50) is adapted to control the tilt means (66) to tilt the load-handling device proportionally to the detected lifting force, so that the load-handling device, with or without load, will constantly maintain a preset inclination relative to the supportive surface.

* * * * *